US008444810B2

(12) United States Patent
Roa-Espinosa

(10) Patent No.: US 8,444,810 B2
(45) **Date of Patent: *May 21, 2013**

(54) APPARATUS AND PROCESS FOR TREATMENT OF FIBERS

(76) Inventor: Aicardo Roa-Espinosa, Madison, WI (US)

( * ) Notice: Subject to any disclaimer, the term of this patent is extended or adjusted under 35 U.S.C. 154(b) by 144 days.

This patent is subject to a terminal disclaimer.

(21) Appl. No.: 12/951,052

(22) Filed: Nov. 21, 2010

(65) Prior Publication Data

US 2012/0125550 A1 May 24, 2012

(51) Int. Cl.
*D21C 9/10* (2006.01)

(52) U.S. Cl.
USPC ..... 162/63; 162/1; 162/60; 162/68; 162/261

(58) Field of Classification Search
USPC ..... 162/60, 63, 68, 1, 264, 234
See application file for complete search history.

(56) References Cited

U.S. PATENT DOCUMENTS 3,574,052 A * 4/1971 Westerlund et al. ..... 162/64
4,303,470 A * 12/1981 Meredith et al. ..... 162/57
4,644,060 A 2/1987 Chou
5,171,592 A 12/1992 Holtzapple et al.
5,473,061 A 12/1995 Bredereck et al.
5,641,385 A * 6/1997 Croft et al. ..... 162/60
6,158,167 A 12/2000 Spittle
6,176,176 B1 1/2001 Dale et al.
6,349,499 B1 2/2002 Spittle
6,360,478 B1 3/2002 Spittle
2003/0172464 A1 9/2003 Hu et al.
2006/0070294 A1 4/2006 Spittle
2007/0029252 A1 * 2/2007 Dunson et al. ..... 210/603
2007/0031953 A1 2/2007 Dunson, Jr. et al.
2008/0008783 A1 1/2008 Dale
2008/0210391 A1 * 9/2008 Pfalzer et al. ..... 162/4
2012/0180962 A1 * 7/2012 Roa-Espinosa ..... 162/60

* cited by examiner

*Primary Examiner* — Jacob Thomas Minskey
(74) *Attorney, Agent, or Firm* — Steven H. Greenfield; Greenfield Invention and Patent Consulting, Inc.

(57) ABSTRACT

A process for treatment of fibers is disclosed. The treatment comprises simultaneously and continuously macerating the fibers and exposing the fibers to superheated steam, ammonia gas and ethylenediamine gas. The treatment is carried out in a chamber where the fibers are subjected to the mechanical rubbing and crushing action of a plurality of rotating pins against channels disposed on the chamber interior wall. The treatment results in improved fiber water holding capacity and improved conversion efficiency in the production of ethanol from the treated fibers.

12 Claims, 4 Drawing Sheets

APPARATUS AND PROCESS FOR TREATMENT OF FIBERS

FIELD OF THE INVENTION

The present invention relates to a process and apparatus for treating fibers and fiber bundles. More specifically, the present invention relates to a process and apparatus for treating raw biomass fibers and fiber bundles that impart properties to the fibers such as improved water holding capacity and crystallinity that are beneficial in a variety of applications such as ethanol manufacturing and soil erosion prevention as well as in products such as plant growth substrates and animal bedding.

BACKGROUND OF THE INVENTION

Biomass materials contain valuable materials that may be used in a variety of applications such as the production of fuels, feeds and chemicals. The release, segregation and collection of these useful materials are accomplished in the art using a variety of chemical, mechanical and enzymatic processes. Of primary benefit is the release of fermentable sugars such as hexose and pentose that can then be used in the production of ethanol. For these processes to be effective, it is desirable to modify the biomass mechanically and chemically.

Prior art references disclose methods for treating fibers with ammonia. U.S. Pat. No. 4,644,060 discloses a method for increasing the bioavailability of polysaccharide components of ligno-cellulosic materials by treatment with ammonia in a supercritical or near-supercritical fluid state at temperatures ranging from 100 degrees C. to 200 degrees C. and pressures ranging from 6.9 MPa to 35 MPa. U.S. Pat. Nos. 5,171,592 and 5,473,061 and US Pre-Grant Publication number 20080008783 describe methods for exploding biomass by rapidly reducing the pressure at which the biomass is treated, thereby exposing the value components in biomass to swelling agents such as ammonia and amines. These processes require high pressure vessels and are difficult and cumbersome to run cost effectively.

SUMMARY OF THE PRESENT INVENTION

Fiber treatments are often conducted in liquid dispersion form wherein the liquid contains the appropriate treating agent and the dispersion is heated to a desired temperature level. This method of treatment is typically inefficient and expensive as the unused treating agents must be recovered from the spent liquid for reuse. In the process of the present invention, fibers are continuously treated in the gas phase in which only the needed amount of treating agent is metered into the treatment chamber. In this manner, very little of the treating agent needs to be wasted or needs to be recovered from the process waste stream.

The process of the present invention comprises a process of treating fibers by continually exposing the surfaces of fibers to treatment agents in a gas phase under superheated steam pressure while separating non-value components such as lignin and hemicelluloses from the fibers to minimize interference from these components with the gas phase treatments. The valuable cellulose fibers may be contained in fiber bundles that are byproducts of harvest or sawmill processes of wood or biomass. Separating the fiber bundles is an important step in order to make the fibers accessible to the treatment agents. This is accomplished in the present invention by applying mechanical maceration action to the fibers in such a manner as to expose the fibers to the softening effect of the superheated steam and treatment agents in the gas phase. One such treatment agent is ethylenediamine that is disclosed as an aid in the removal of lignin in U.S. Pat. No. 5,641,385. The lignin acts as glue in the cellulose fiber matrix and therefore reduces the accessibility of reactants that may be used to impart beneficial physical characteristics to the cellulose fibers or to extract valuable chemicals from cellulose and biomass fibers. Sources for biomass fibers include but not limited to: cotton, mulch, switch grass, burr plants, wheat, sorghum, hey, Sudan grass, paper waste, municipal sewer solids, manure solids, sugar cane, cassaya, corn and wheat and other cereals straw. The combination of these process steps may be carried out simultaneously at a relatively low pressure of about 2 Kilo Pascal gauge.

Maceration of fibers in the context of the present invention refers to applying mechanical action to fibers and fiber bundles such as grinding or refining while the fibers are exposed to any or all of the following: liquids, vapors, heat and chemicals. Defiberizing refers to mechanical action applied to fiber bundles with the intent of separating the bundles into smaller bundles and individual fibers, typically under ambient or close to ambient conditions and without chemical aids. Defiberizing is more likely than maceration to result in reducing the length of the fibers.

It is the object of the present invention to provide a process for transforming biomass fibers into materials useable in the production of ethanol. It is also the object of the present invention to provide processes for transforming biomass fibers into materials useable in soil erosion applications and into materials useable as animal feed, animal bedding, and fertilizers. It is further the object of the present invention to provide treated fibers having improved water holding capacity. It is yet another object of the present invention to provide fibers that have a high degree of crystallinity that makes the sugar components of the fibers accessible to enzymatic treatment.

In one aspect of the present invention, a process for treating fibers containing cellulose, lignin and hemicelluloses wherein the fibers typically are aggregated into bundles comprises: macerating the fibers; removing at least a portion of the lignin from the fibers; softening the fibers; and swelling the fibers.

In another aspect of the present invention a process for treating fibers comprises: feeding fibers into a feed opening of a treatment apparatus, the fibers being aggregated in fiber bundles; macerating the fibers; feeding a gaseous mixture containing steam, ammonia and ethylenediamine into the treatment apparatus at a temperature of between about 140 degrees C. and about 180 degrees C. and a pressure of about 2 kilopascals gauge; moving the fibers from the feed opening to an exit opening of the treatment apparatus; and collecting the fibers at the exit opening of said treatment apparatus.

These and other features, aspects and advantages of the present invention will become better understood with reference to the following drawings, description and claims.

DETAILED DESCRIPTION OF THE INVENTION

Figure 1:
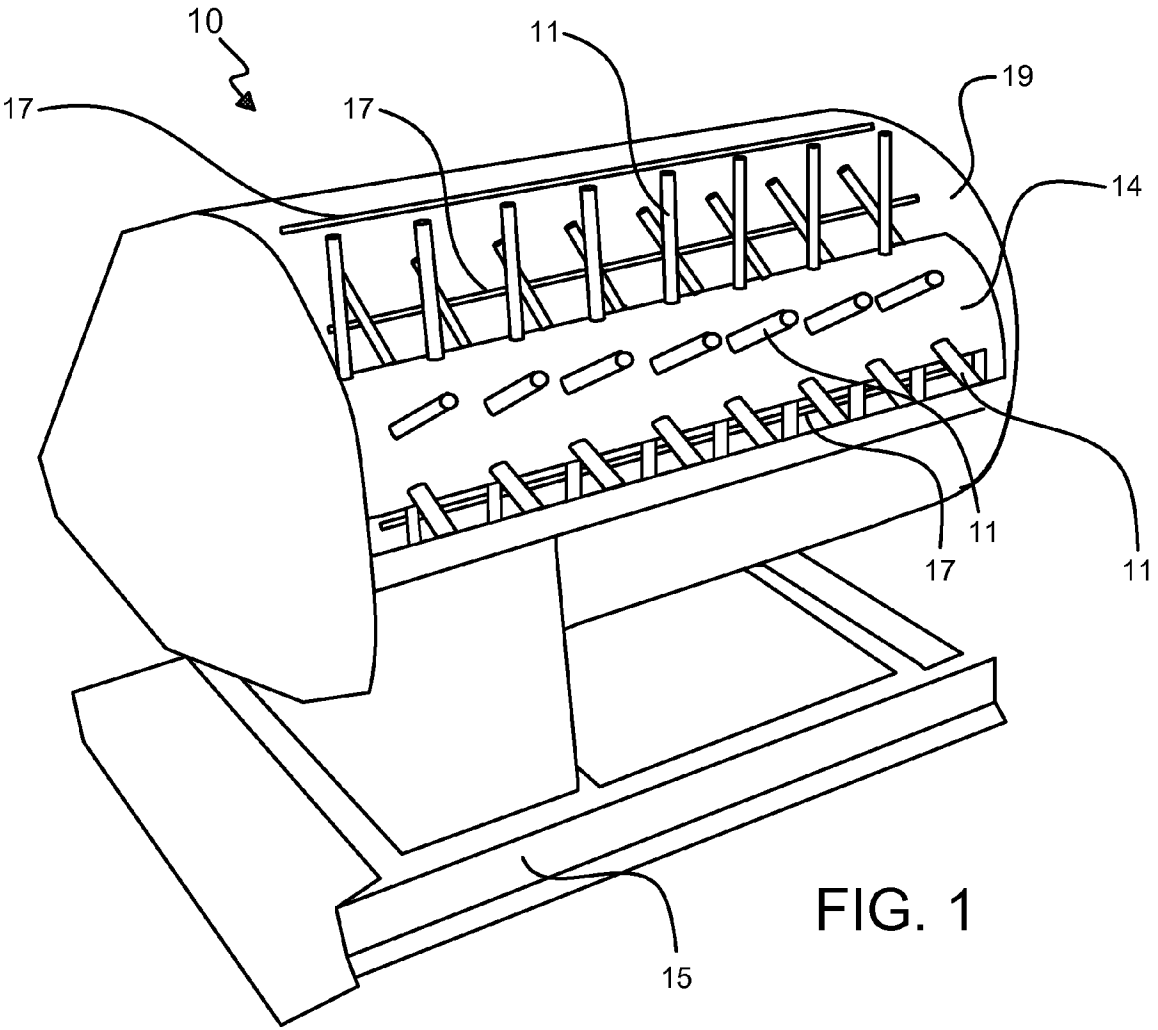
FIG. 1 is a front side cross sectional view of the apparatus for treating fibers according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

The present invention relates to a process for producing fibers useful in a variety of applications from fibers that originate from brush, trees and plants that undergo processes which create residuals. Frequently, these residuals come in the form of fiber bundles that, at present, are mostly disposed of as waste. The sources include, wood chips and saw dust that originate from saw mill residuals, mulch and biomass residuals from processing cotton, animal manure fibers, switch grass, burr plants, wheat, barley, oats, rye, triticale, sorghum, hey and Sudan grass the fiber bundles contain cellulosic components that may be useful as additives in animal feed and potting soil, soil erosion prevention and production of ethanol. However, the fibers must first be released from the bundles and rendered in a form amenable to further treatments and transformations. The process of the present invention accomplishes the release of the useful cellulosic components in the fibers by subjecting the fibers and the fiber bundles to four steps that take place substantially simultaneously and continuously: softening, swelling, macerating, and removing at least a portion of materials that do not provide end use application value such as lignin and hemicelluloses.

The treatment apparatus constitutes a modified pin mixer having a configuration such as that disclosed in U.S. Pat. No. 4,334,788. The apparatus comprises a long cylindrical chamber configured to operate under pressure. A plurality of pins is disposed on and attached to a central shaft configured longitudinally along the chamber and adapted to rotate radially. The pins may be disposed perpendicularly in relation to the shaft and may be arranged in a plurality of rows offset radially from one to another. The chamber comprises inner cylindrical walls that may contain a plurality of channels disposed longitudinally along the inner surface of the chamber. The channels may range from about 0.2 inches to about 0.5 inches in width and from about 0.2 inches to about 0.5 inches in depth, and their clearance from the unattached end of the pins may range from about 0.1 inches to about 0.3 inches. Fibers and fiber bundles are fed through a feed opening most typically using a screw feeder. As the fibers move through the chamber and toward the exit opening, fiber bundles accumulate inside the channels and separate into smaller bundles from the rubbing and crushing action of the pins as the shaft rotates; all the while the fibers and fiber bundles continue a forward movement from the feed opening to the exit opening. The pin to fiber action also results in opening the fiber walls as well as fiber length reduction which may be undesirable.

A mixture of steam, gaseous ammonia and gaseous amine, such as ethyleneamine or ethylenediamine is fed through openings in the chamber. In an embodiment of the present invention, superheated steam at a temperature in the range of about 140-180° C. and a pressure of about 2 Kilopascals gauge is used. The steam softens the fiber bundles, which facilitates the macerating action of the pins to separate the fibers while reducing the likelihood of fiber length reduction. The exposure of the fibers to gaseous ammonia results in the swelling of the fibers consistent with the disclosure in U.S. Pat. No. 5,473,061. The swelling of the fibers further facilitates fiber maceration without excessive fiber damage. As the maceration of the fibers proceeds, lignin and hemi-cellulose fragments are separated from the cellulosic components of the fibers. The lignin and hemi-cellulose materials interfere with the utilization of cellulosic fiber materials in the production of ethanol and use in soil erosion applications; thus their removal is desirable. As the lignin and hemicelluloses are removed, the crystalline components of the fibers are exposed to chemical and enzymatic treatment. The removal of these materials is aided in the context of the present invention by the use of ethylenediamine consistent with the disclosure in U.S. Pat. No. 5,641,385.

It will be appreciated by those skilled in the art that the continuous feeding of the fiber bundles and the continuous feeding of the gaseous mixture containing steam, ammonia gas and ethylenediamine allow carrying out the process steps of: softening the fibers, swelling the fibers, macerating the fibers and removing at least a portion of the lignin to occur substantially simultaneously in the treatment apparatus and to proceed in a substantially continuous manner. It will also appreciated by those skilled in the art that in a continuous operation, feeding the gaseous mixture may be optimized for the feeding rate that matches those of the fibers in a way that the ammonia and ethylenediamine produce the best treatment results, allow recycling spent chemicals if needed and produce minimum waste for disposal. The mechanical treatment variables have a major effect on the continuous treatment process of the fibers. Specifically, it was found experimentally that the best results were achieved for pin rotation speeds in a range from about 800 to about 2000 rpm. For the purposes of the present invention, the pins may be arranged in six to eight rows around the shaft, with each row having 2-5 pins per foot of shaft length.

In an embodiment of the present invention, the gaseous mixture of steam, ammonia and ethylenediamine is produced by heating an aqueous solution containing an ammonium based compound and ethylenediamine to a temperature of about 140-180° C. The ammonium based compound may be anhydrous ammonia or urea. The anhydrous ammonia is easily vaporized, while urea dissociates into ammonia $NH_3$ and iso-cyanic acid HNCO at about 140° C. The ethylenediamine also exists in the gas phase in this temperature range, as its boiling point is about 116° C. The steam in this temperature range of about 140-180° C. and pressure of about 2 Kilo Pascal gauge is in the superheated range. The aqueous solution may contain about 10-15% by weight of anhydrous ammonia or urea and about 10-15% by weight of ethylenediamine. The ratio of ammonia feed rate and fiber feed rate may be about 1:1 on a dry weight basis. Dwell time of the fibers in the treatment apparatus may range from about 2-15 minutes. The treatment may further comprise presoaking or spraying the fiber bundles with a solution of calcium oxide as the treatments are enhanced under alkaline conditions. The calcium oxide application is in the range of about 2% to about 10% by weight of the oven dry fiber and preferably in the range of about 4% to about 7% by weight of the oven dry fiber. The treatment may further comprise presoaking or spraying the fiber bundles with a 0.1 to 1% solution of sodium hydroxide by weight of the oven dry fiber and preferably in the range of about 0.3% to about 0.7% by weight of the oven dry fiber as needed to control the desired alkalinity level of the treatments. A defiberizing step may be required prior to treatment if the bundles are larger than about 1 inch or the fibers are longer than about 1 inch. Defiberizing may be accomplished by methods known in the art such as grinding, hammer-milling and refining.

The fibers exiting from the treatment apparatus may be further washed to remove any residual lignin and hemi-cellulose fragments then dried. The treated fibers have significantly improved water holding capacity compared to untreated fibers, which make them suitable for soil erosion applications, soil potting, seed bedding, animal feed, and fertilizer with slow release. The crystallinity of the fibers is also significantly improved which makes the sugar components, e.g., glucan, more accessible to enzymatic treatment. For ethanol production, the treated fibers are further reacted with sacharifier enzyme and fermenting yeast.

Figure 2:
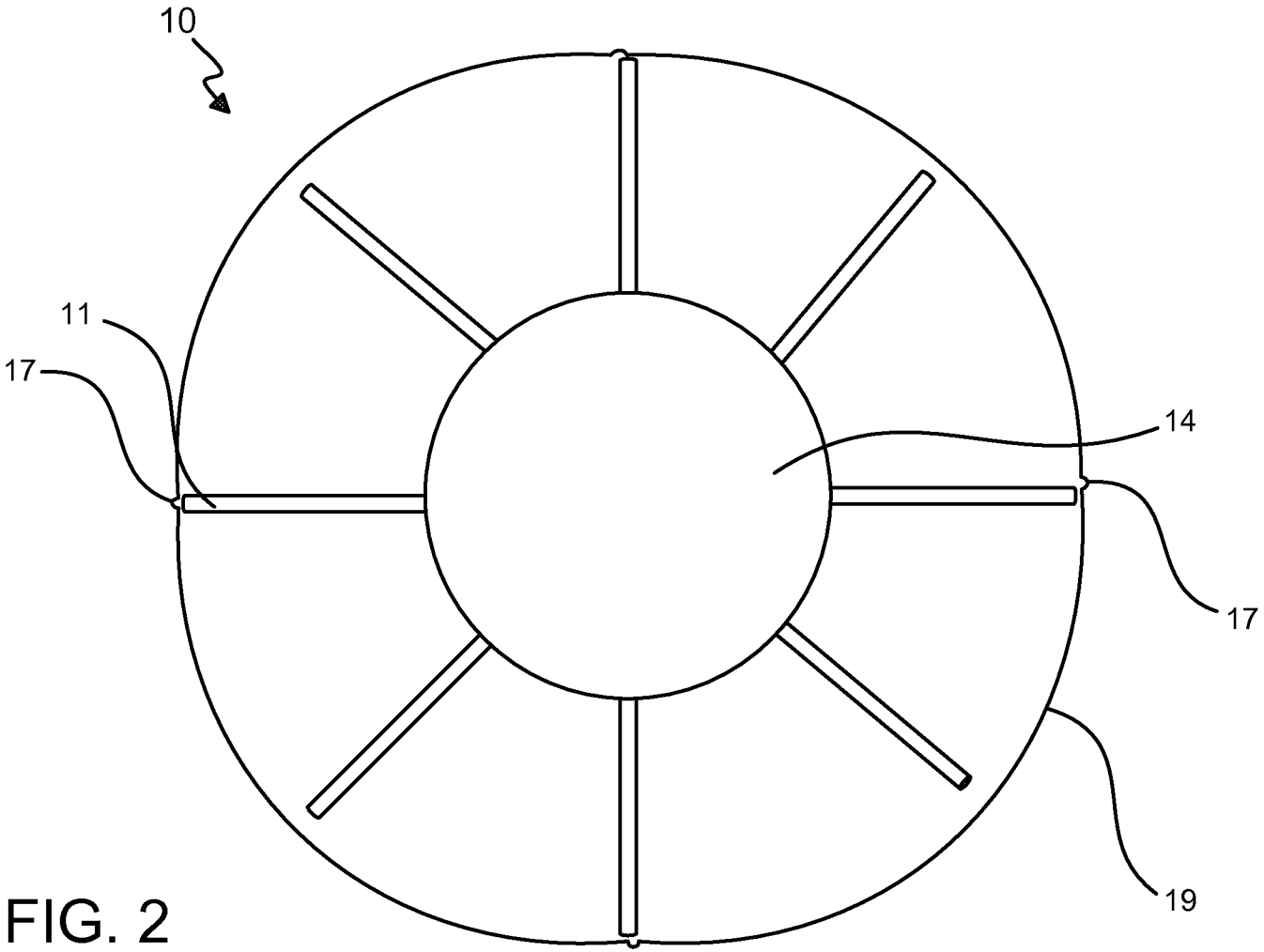
FIG. 2 is a side cross sectional view of the apparatus for treating fibers according to an embodiment of the present invention.
Figure 3:
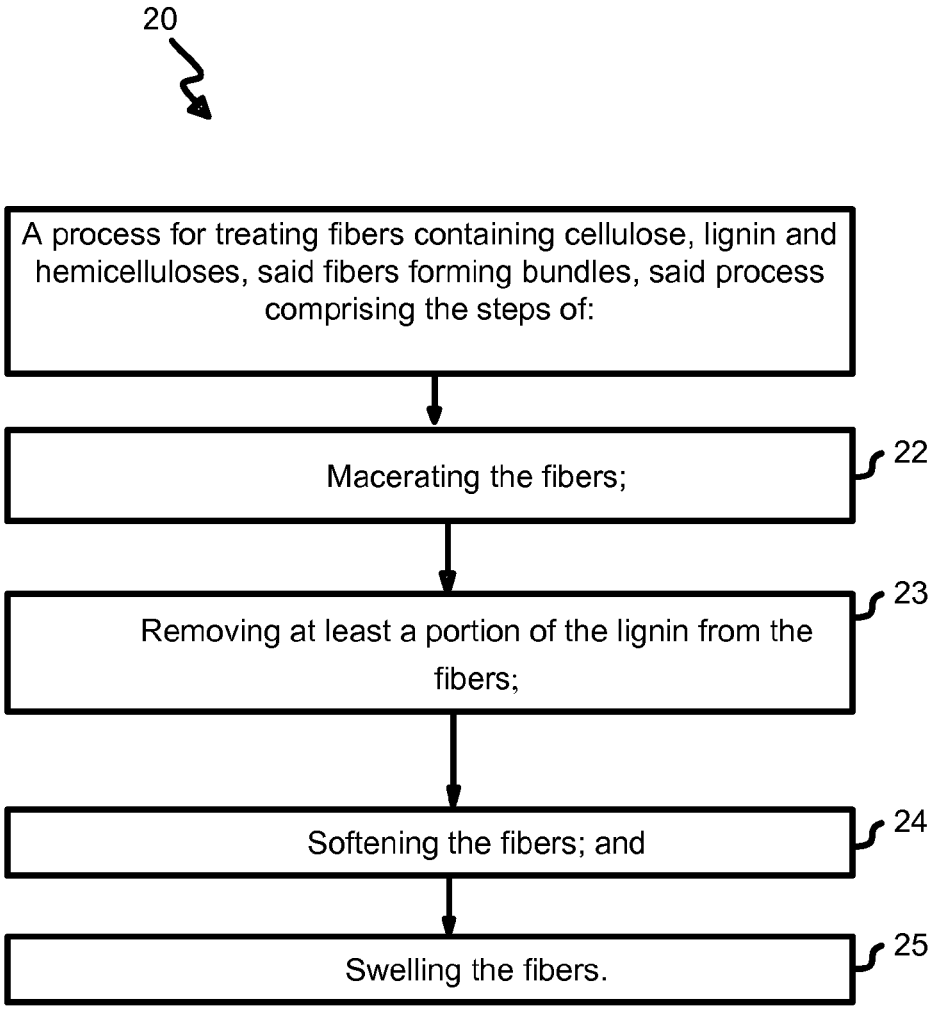
FIG. 3 is a flow chart of mechanistic process steps for treating fibers according to an embodiment of the present invention.
Figure 4:
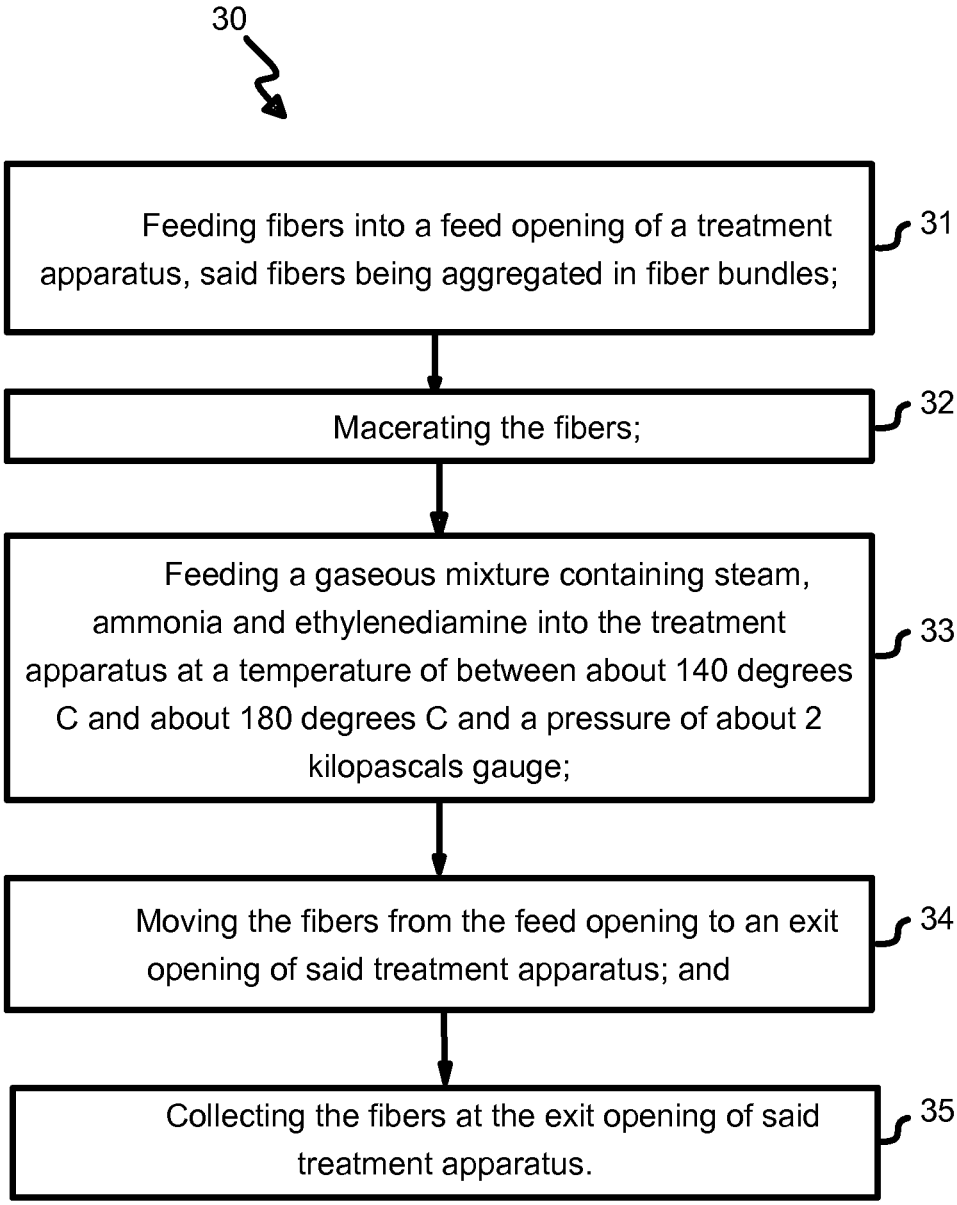
FIG. 4 is a flow chart of a process for treating fibers according to an embodiment of the present invention.

FIGS. 1 and 2 illustrate the apparatus 10 for treating fibers showing the pins 11, the shaft 14 adapted for radial rotation, chamber walls 19, channels 17 and a base 15. FIGS. 3 and 4 provide a chart for the process of the present invention. FIG. 3 outlines the mechanistic steps 20 of the process: softening the fibers 24, removing at least a portion of the lignin from the cellulose matrix 23, macerating the fibers 22, and swelling the fibers 25. FIG. 4 outlines the key process steps for achieving the fiber treatments: feeding fibers into a feed opening of a treatment apparatus 31, macerating the fibers 32, feeding a gaseous mixture containing steam, ammonia and ethylenediamine into the treatment apparatus at a temperature of between about 140 degrees C. and about 180 degrees C. and a pressure of about 2 kilopascals gauge 33, moving the fibers from the feed opening to an exit opening of the treatment apparatus 34 and collecting the fibers at the exit location of the treatment apparatus 35.

It should be understood, of course, that the foregoing relates to exemplary embodiments of the invention and that modifications may be made without departing from the spirit and scope of the invention.

EXAMPLES

The following tables provide ethanol conversion efficiencies and water holding capacity measurements for treated fibers resulting from two fiber treatment processes. The fibers originated from several biomass sources.

Untreated fibers were produced by macerating the fibers in a pin mixer in the presence of steam at about 150 degrees C. and a pressure of about 2 Kilo Pascal gauge for about 10 minutes but without the introduction of chemicals into the treatment vessel.

Process 1 comprised of spraying the fibers bundles with a 4% Calcium Oxide by weight of oven dried fibers, macerating the fibers in a pin mixer in the presence of steam at about 150 degrees C., and ammonia originating from heating a solution containing about 5% urea by weight of the dry fibers. The pressure in the treatment vessel was 2 Kilo Pascal gauge. The process was carried out for 5 minutes of dwell time and for 10 minutes of dwell time in the treatment vessel.

The treated fibers were collected from the treatment vessel and converted to Ethanol according to National Renewal Energy Laboratory (NREL) Laboratory procedure LAP-008. Simultaneous saccharification and fermentation experiments were conducted. Each SSF flask was loaded with 3% (w/w) glucan, 1% (w/v) yeast extract, 2% (w/v) peptone, 0.05 M citrate buffer (pH 4.8), the appropriate amount of cellulose enzyme (Spezyme CP, provided by NREL) to achieve 10 FPU/g glucan, the appropriate amount of Saccharomyces cerevisiae $D_5A$ (provided by NREL). The flasks were equipped with water traps to maintain anaerobic conditions and were incubated at 37 C. with gentle rotation for a period of 168 hours. The amount of ethanol generated in this process provided a % yield relative to the weight of the dry treated fibers.

The water holding capacity was determined by the steps of 1) drying the treated fibers, 2) saturating the fibers with excess water for one minute, 3) draining the excess water in a strainer until the gravitational water drainage stops and 4) weighing the fibers after the excess water drainage. The water holding capacity was then determined as the weight ratio of the water pick-up to the dry fibers.

The crystallinity of the fibers was measured using a multi-wire x-ray diffraction detector by the Bruker-AXS Corporation in Madison, Wis. The results are shown in the tables below:

Test Results for the Untreated Fibers

| Fiber/Source | Crystallinity (%) | Water Holding Capacity, g/g | Untreated fiber ethanol yield (%) |
|---|---|---|---|
| Sudan grass | 0 | 2.7 | 35 |
| Johnson grass | 0 | | 33 |
| Hay grass | 0 | 3.0 | 33 |
| Wheat straw | 0 | 2.9 | 36 |
| Sorghum | 0 | 3.7 | 30 |
| Switch grass | 0 | 2.6 | 32 |
| Sugar cane baggase | 0 | | 34 |
| Cotton trash | 0 | 2.5 | 30 |
| Rice straw | 0 | | 36 |
| Wood fibers | 0 | 1.7 | 36 |

Five Minute Pre-Treatment

| Fiber/Source | Crystallinity (%) | Water holding capacity (g/g) | Ethanol yield (%) |
|---|---|---|---|
| Sudan grass | 20 | 4.2 | 82 |
| Johnson grass | 20 | 4.3 | 80 |
| Hay grass | 23 | 3.8 | 82 |
| Wheat straw | 25 | 4.5 | 83 |
| Sorghum | 22 | 5.5 | 83 |
| Switch grass | 26 | 6.7 | 80 |
| Sugar cane baggase | 23 | 5.8 | 85 |
| Cotton trash | 23 | 5.6 | 79 |
| Rice straw | 20 | 4.6 | 85 |
| Wood fibers | 28 | 5.6 | 85 |

Ten Minute Pre-Treatment

| Fiber/Source | Crystallinity (%) | Water holding capacity (g/g) | Ethanol yield (%) |
|---|---|---|---|
| Sudan grass | 42 | 7.2 | 91 |
| Johnson grass | 45 | 7.2 | 90 |
| Hay grass | 45 | 6.6 | 89 |
| Wheat straw | 47 | 6.4 | 91 |
| Sorghum | 43 | 8.1 | 90 |
| Switch grass | 45 | 9.4 | 93 |
| Sugar cane baggase | 40 | 7.7 | 93 |
| Cotton trash | 40 | 7.2 | 87 |
| Rice straw | 45 | 8.5 | 92 |
| Wood fibers | 45 | 9.1 | 92 |

In Process 2, the fibers were macerated in a pin mixer at 1500 rpm in the presence of steam at about 150 degrees C., a pressure of about 1.7-2.0 Kilo Pascal gauge, ammonia originating from heating a solution containing from 10% urea and 5% ethylenediamine to about 150 degrees C. The process was carried out for 5 minutes of dwell time and for 10 minutes of dwell time.

The treated fibers were collected from the treatment vessel and converted to Ethanol according to National Renewal Energy Laboratory (NREL) Laboratory procedure LAP-008. Simultaneous saccharification and fermentation experiments were conducted. Each SSF flask was loaded with 3% (w/w) glucan, 1% (w/v) yeast extract, 2% (w/v) peptone, 0.05 M citrate buffer (pH 4.8), the appropriate amount of cellulose enzyme (Spezyme CP, provided by NREL) to achieve 10 FPU/g glucan, the appropriate amount of Saccharomyces cerevisiae $D_5A$ (provided by NREL). The flasks were equipped with water traps to maintain anaerobic conditions and were incubated at 37 C. with gentle rotation for a period of 168 hours. The crystallinity of the fibers was measured using a multi-wire x-ray diffraction detector by the Bruker-AXS Corporation in Madison, Wis. The results are shown below:

Five Minute Pre-Treatment

| Fiber/Source | Crystallinity (%) | Water holding capacity (g/g) | Ethanol yield (%) |
|---|---|---|---|
| Sudan grass | 38 | 4.8 | 85 |
| Johnson grass | 38 | 4.9 | 83 |
| Hay grass | 31 | 4.1 | 84 |
| Wheat straw | 38 | 4.9 | 85 |
| Sorghum | 40 | 5.8 | 85 |
| Switch grass | 40 | 6.9 | 82 |
| Sugar cane baggase | 44 | 6.2 | 87 |
| Cotton trash | 38 | 5.9 | 82 |
| Rice straw | 41 | 6.2 | 87 |
| Wood fibers | 43 | 6.1 | 87 |

Ten Minute Pre-Treatment

| Fiber/Source | Crystallinity (%) | Water holding capacity (g/g) | Ethanol yield (%) |
|---|---|---|---|
| Sudan grass | 47 | 7.8 | 92 |
| Johnson grass | 49 | 7.7 | 93 |
| Hay grass | 49 | 7.1 | 91 |
| Wheat straw | 50 | 6.9 | 93 |
| Sorghum | 48 | 8.8 | 93 |
| Switch grass | 51 | 9.7 | 95 |
| Sugar cane baggase | 46 | 8.1 | 95 |
| Cotton trash | 45 | 7.9 | 91 |
| Rice straw | 50 | 8.8 | 95 |
| Wood fibers | 50 | 9.3 | 95 |

The crystallinity of the untreated fibers was =0.0, i.e., the untreated fibers were completely amorphous. The enzymatic conversion of the untreated fibers to ethanol ranged from a yield of 30% to 36%. Crystallinity levels of around 50% and enzymatic conversion of ethanol in the 91% to 95% range were achieved with Process 2. Water holding capacity levels in the 7 g/g to around 10 g/g were achieved with this process. A high water holding capacity is a beneficial attribute in soil erosion applications. As can be seen, the process provides significant improvements in fiber crystallinity and water holding capacity.

I claim:

1. A process for treating fibers comprising:

feeding fibers and fiber bundles into a feed opening of a treatment apparatus;

macerating the fibers and fiber bundles;

feeding a gaseous mixture containing steam, ammonia and ethylenediamine into the treatment apparatus at a temperature of between about 140 degrees C. and about 180 degrees C. and a pressure of about 2 kilopascals gauge;

moving the fibers from the feed opening to an exit opening of said treatment apparatus;

collecting the fibers at an exit opening of said treatment apparatus said treatment apparatus comprising a chamber having a longitudinal central axis, a cylindrical enclosure, an interior portion having an interior surface and an exterior portion, said feed opening being adapted for communication with a fiber feeding device, said chamber being adapted for utilization under pressure;

a shaft disposed along the longitudinal central axis of said chamber, said shaft being adopted for rotation around said axis;

a plurality of pins affixed to said central axis, said pins protruding from the central axis, said pins being substantially perpendicular in relation to the central axis; and furrows disposed in an inner wall surface of the cylindrical enclosure having a predetermined width, a predetermined depth and a predetermined clearance from the pins, wherein said fiber bundles accumulate inside the furrows, said fiber bundles breaking apart inside said furrows from impact by the pins while said fiber bundles and fibers continually moving from the feed opening to the exit opening of said treatment apparatus.

2. The process of claim 1, wherein the clearance between the furrows and the pins ranges from about 0.1 inches to about 0.3 inches.

3. The process of claim 1, wherein the depth and the width of said furrows range from about 0.2 inches to about 0.5 inches.

4. The process of claim 1, wherein a method for producing the mixture of steam, gaseous ammonia, and gaseous ethylenediamine comprises heating an aqueous solution containing an ammonium base compound and ethylenediamine to a temperature between 140° C. and 180° C.

5. The process of claim 1, further comprising spraying the fibers with a solution of calcium oxide at an application rate of about between 2% and 10% by weight of the dry fibers prior to feeding the fibers into the treatment apparatus.

6. The process of claim 1, further comprising washing the fibers collected at the exit of the treatment apparatus, and drying the fibers.

7. The process of claim 1, wherein macerating the fibers comprises rotating the shaft in a revolution range of between 800 and 2000 rpm.

8. The process of claim 1, further comprising defiberizing the fiber bundles prior to treatment.

9. The process of claim 1, wherein the gaseous mixture further comprises 10% ethanol by volume.

10. The process of claim 4, wherein a content of the ammonium base compound in the aqueous solution ranges from about 5 percent to about 15 percent by weight of the dry fibers.

11. The process of claim 4, wherein a content of the ethylenediamine in the aqueous solution ranges from about 5 percent to about 15 percent by weight of the dry fibers.

12. The process of claim 4, wherein the ammonium base compound comprises urea.

* * * * *